US009823054B1

(12) United States Patent
Giles, II

(10) Patent No.: US 9,823,054 B1
(45) Date of Patent: Nov. 21, 2017

(54) BULLET PULLER

(71) Applicant: Grant Eugene Giles, II, Spicewood, TX (US)

(72) Inventor: Grant Eugene Giles, II, Spicewood, TX (US)

( * ) Notice: Subject to any disclaimer, the term of this patent is extended or adjusted under 35 U.S.C. 154(b) by 0 days.

(21) Appl. No.: 15/272,849

(22) Filed: Sep. 22, 2016

(51) Int. Cl.
*F42B 33/06* (2006.01)

(52) U.S. Cl.
CPC ..... *F42B 33/06* (2013.01)

(58) Field of Classification Search
CPC ..... F42B 33/06
USPC ..... 86/49; 29/275
See application file for complete search history.

(56) References Cited

U.S. PATENT DOCUMENTS 3,898,908 A * 8/1975 Isenhower ..... F42B 33/06 269/239
5,333,367 A 8/1994 Ashbrook
5,490,313 A 2/1996 Ashbrook
5,533,246 A 7/1996 Ashbrook

* cited by examiner

*Primary Examiner* — Reginald Tillman, Jr.
(74) *Attorney, Agent, or Firm* — Chrisptopher L. Makay

(57) ABSTRACT

A bullet puller includes a plastic carrier tube, a metal insert, an annular segmented support, a cap, and a handle. The plastic carrier tube has an opening at its upper end adapted to receive the cartridge and a head at its lower end adapted to be struck against a hard surface. The metal insert resides atop the upper end of the plastic carrier tube thereby protecting the upper end of the plastic carrier tube during use of the bullet puller. The annular segmented support is disposed atop the metal insert for engaging the cartridge. The cap movably secures over the opening at the upper end of the plastic carrier tube for moving the annular segmented support radially inward. The handle connects at one end to the plastic carrier tube to strike it against a hard surface.

20 Claims, 2 Drawing Sheets

BULLET PULLER

BACKGROUND OF THE INVENTION

Field of the Invention

The present invention relates to kinetic/inertial bullet pullers which are devices utilized to remove bullets from cases of cartridge type rounds of ammunition. Kinetic/inertial bullet pullers operate first by imparting a rapid motion to the cartridge and then bringing the case thereof to a quick stop. When the case slows down, it tries to slow down the bullet too, thereby imposing tension on the connection between the bullet and the case. If the tension force is great enough, the connection parts, which is the desired result. The tension force is proportional to the time rate of change in the momentum of the bullet and for any given bullet mass is proportional to the time rate of change in bullet velocity. The latter depends on the initial velocity of the bullet and upon the length of time required to stop it, which, in turn, depends on a speed of propagation of a kinetic/elastic shock wave through the material carrying the cartridge case.

Discussion of the Related Art

Related art kinetic/inertial bullet pullers include a rigid cartridge carrier in the form of a transparent, plastic material tube having an opening at a first end adapted to receive a cartridge and provided at its second end with a head portion adapted to be struck against a hard surface. A cartridge support, typically made of metal, is provided at and resides atop the first end of the carrier tube for engaging the cannelure or other portion of the cartridge case. The head end of the carrier tube extends beyond the nose of the bullet and is closed with its interior being tapered at the lower end. A securing cap fits over the cartridge support and engages the carrier tube to hold the cartridge support against the first end of the carrier tube.

In use, a cartridge is placed in the carrier tube and supported therein by the cartridge support which engages the cannelure. The securing cap secures the cartridge support to the first end of the carrier tube and further ensures the cartridge support firmly engages the cannelure. The head portion at the end of the carrier tube is struck one or more times against a hard surface such as the top of a table until the bullet pulls free of the case. To facilitate accelerating the carrier to a high velocity and striking it against a fixed hard surface, the carrier tube is provided with a handle extending transversely from the carrier tube. The resulting carrier tube and handle combination has the overall shape of a hammer.

While the related art bullet pullers operate satisfactorily, the use of a metal cartridge support residing on top of a plastic cartridge carrier tube provides a less than adequate interface therebetween. The striking of the head portion of the carrier tube against a hard surface imparts a kinetic energy shock wave into the plastic cartridge carrier tube, which is delivered as a force at the first end of the plastic cartridge carrier tube bearing the metal cartridge support. In accordance therewith, the plastic cartridge carrier tube experiences an impact at its first end as the metal cartridge support slams against the first end of the plastic cartridge carrier tube. Repeated use of a related art bullet puller where the plastic cartridge carrier tube absorbs the impact force of the metal cartridge support results in wear of the plastic first end due to its contact with the metal cartridge support. At some point, the wear reaches a level where the related art bullet puller fails to function properly. Consequently, the plastic/metal interface between the carrier tube and the cartridge support shortens the operational life of related art bullet pullers.

Accordingly, a bullet puller and insert incorporated therein that improves the plastic/metal interface between the carrier tube and the cartridge support will increase the operational life of new bullet pullers or extend the operational life of existing bullet pullers.

SUMMARY OF THE INVENTION

In accordance with the present invention, a bullet puller separates a bullet of a cartridge separates from a case of the cartridge. The bullet puller includes a carrier tube, an insert, an annular segmented support, a cap, and a handle. The carrier tube includes at its upper end a planar upper surface and an opening adapted to receive a cartridge therein and at its lower end a head adapted to be struck against a hard surface. The carrier tube in the preferred embodiment is constructed from a plastic. The insert is disposed about the upper end of the carrier tube. The insert in the preferred embodiment is constructed from a metal. An annular segmented support is disposed atop the insert for engaging the cartridge. The cap, which includes an opening therethrough, movably secures over the opening at the upper end of the carrier tube in order to move the annular segmented support radially inward. The handle connects at one end to the carrier tube for imparting motion to the carrier tube to strike it against the hard surface.

The insert defines an aperture having a diameter larger than the largest cartridge used in the bullet puller. The insert includes a platform located atop a base whereby, in the preferred embodiment, the platform and the base are constructed integrally from a metal. The metal platform resides atop the planar upper surface of the upper end of the plastic carrier tube such that the metal platform substantially, completely covers the planar upper surface thereby protecting the planar upper surface during use of the bullet puller. The metal base fits within the opening of the plastic carrier tube directly adjacent a portion of an inner surface of the plastic carrier tube at the opening such that the metal base maintains the metal platform atop the planar upper surface in alignment therewith and further protects an entrance into the opening. The metal insert concentrates a kinetic energy shock wave at the annular segmented support, thereby increasing an upwardly directed pushing force of the annular segmented support relative to the cartridge.

A method of extending an operational life of a bullet puller includes placing the metal insert of the present invention atop the upper end of the plastic carrier tube. The base of the metal insert fits within the opening of the plastic carrier tube thereby protecting an entrance into the opening during use of the bullet puller. Furthermore, the platform of the metal insert resides atop the planar upper surface of the upper end of the plastic carrier tube thereby protecting the planar upper surface during use of the bullet puller. After placing the metal insert of the present invention atop the upper end of the plastic carrier tube, the annular segmented support is placed atop the metal insert. The cap is secured over the opening at the upper end of the plastic carrier tube. A cartridge is introduced into the upper end of the plastic carrier tube through the opening in the cap until the cartridge resides atop the annular segmented support. The cap is tightened, and the head of the plastic carrier tube is struck against a hard surface using the handle until a bullet of the cartridge separates from a case of the cartridge.

A method of extending an operational life of a bullet puller further includes providing multiple metal inserts. Each metal insert includes a different diameter aperture, a differently sized platform, and a differently sized base. A metal insert from among the multiple metal inserts is selected. The platform of the selected metal insert is sized to fit within a space of the planar upper surface of the plastic carrier tube, and the base of the selected metal insert is sized to fit within the opening of the plastic carrier tube. The selected metal insert then is placed atop the upper end of the plastic carrier tube. The base of the selected metal insert fits within the opening of the plastic carrier tube thereby protecting an entrance into the opening during use of the bullet puller, and the platform of the selected metal insert resides atop the planar upper surface of the upper end of the plastic carrier tube thereby protecting the planar upper surface during use of the bullet puller. After placing the selected metal insert of the present invention atop the upper end of the plastic carrier tube, the annular segmented support is placed atop the selected metal insert. The cap is secured over the opening at the upper end of the plastic carrier tube. A cartridge is introduced into the upper end of the plastic carrier tube through the opening in the cap until the cartridge resides atop the annular segmented support. The cap is tightened, and the head of the plastic carrier tube is struck against a hard surface using the handle until a bullet of the cartridge separates from a case of the cartridge.

It is, therefore, an object of the present invention to provide a kinetic/inertial bullet puller with a metal insert that protects an upper end of a plastic carrier tube.

It is another object of the present invention to extend an operational life of a kinetic/inertial bullet puller through the inclusion of a metal insert disposed over an upper end of a plastic carrier tube.

It is a further object of the present invention to provide a metal insert that concentrates a kinetic energy shock wave at an annular segmented support of a kinetic/inertial bullet puller, thereby increasing an upwardly directed pushing force of the annular segmented support relative to a cartridge.

Still other objects, features, and advantages of the present invention will become evident to those skilled in the art in light of the following.

DETAILED DESCRIPTION OF THE PREFERRED EMBODIMENT

As required, detailed embodiments of the present invention are disclosed herein; however, it is to be understood that the disclosed embodiments are merely exemplary of the invention, which may be embodied in various forms. Figures are not necessarily to scale, and some features may be exaggerated to show details of particular components or steps.

Figure 1:
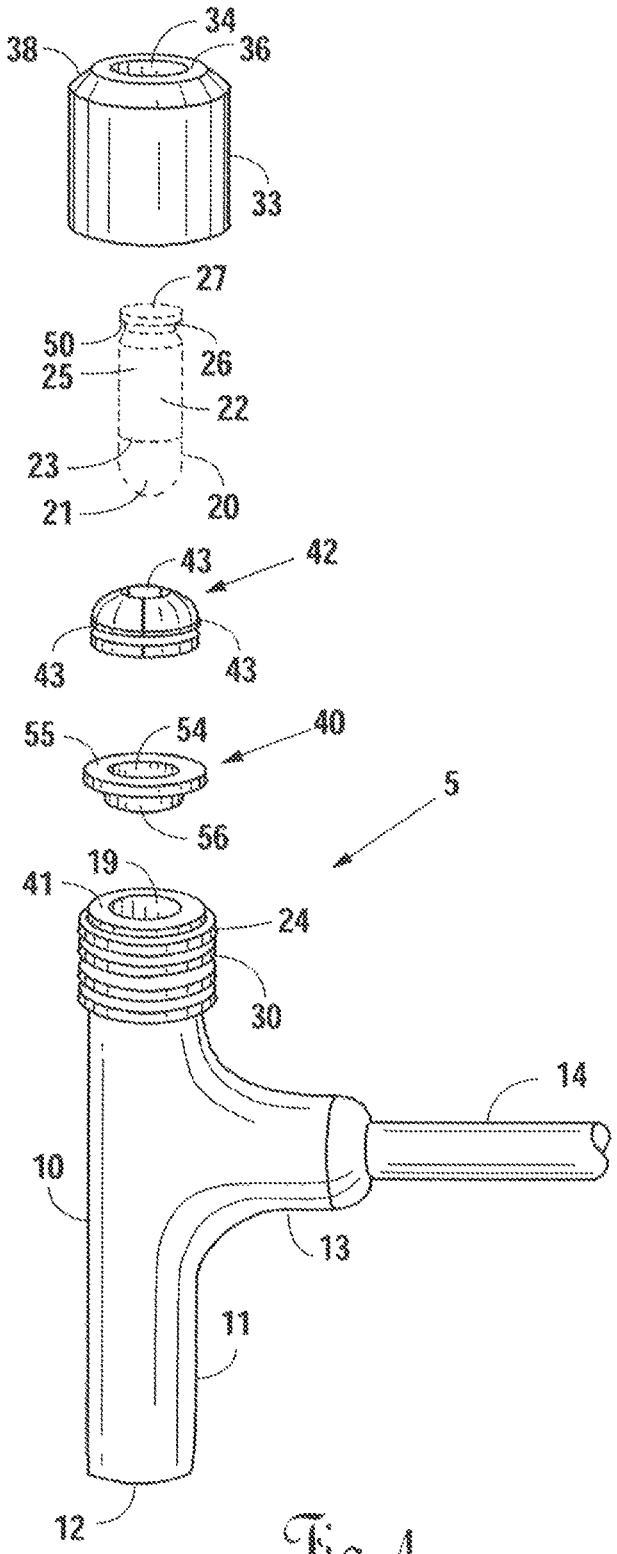
FIG. 1 is a perspective view illustrating a kinetic/inertial bullet puller according to a preferred embodiment of the present invention.
Figure 2:
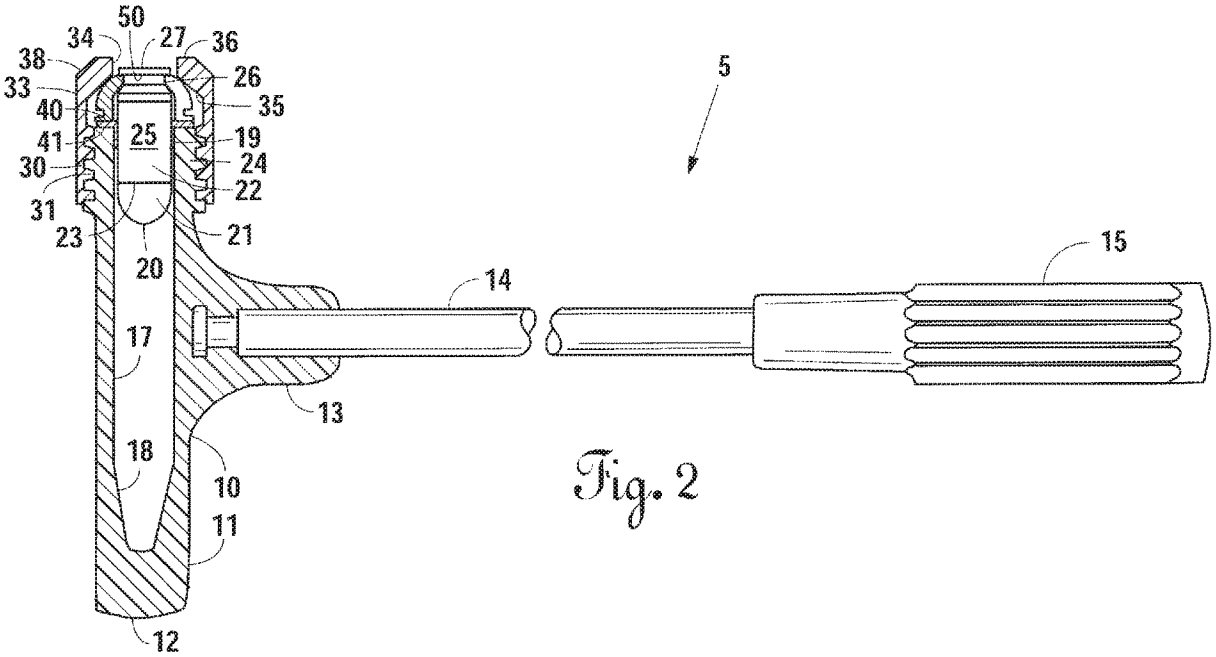
FIG. 2 is a side view in partial cross-section illustrating showing a kinetic/inertial bullet puller according to a preferred embodiment of the present invention.
Figure 6:
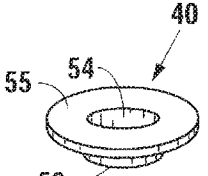
FIG. 6 is a perspective view illustrating an insert for a kinetic/inertial bullet puller according to a preferred embodiment of the present invention.
Figure 5:
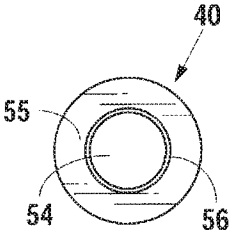
FIG. 5 is a bottom view illustrating an insert for a kinetic/inertial bullet puller according to a preferred embodiment of the present invention.
Figure 4:
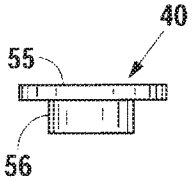
FIG. 4 is a side view illustrating an insert for a kinetic/inertial bullet puller according to a preferred embodiment of the present invention.
Figure 3:
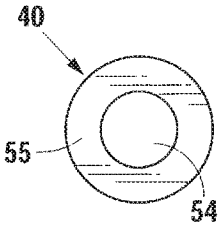
FIG. 3 is a top view illustrating an insert for a kinetic/inertial bullet puller according to a preferred embodiment of the present invention.

Referring now to the drawings and especially to FIGS. 1 and 2, there is shown a kinetic/inertial bullet puller 5 including a carrier tube 10. The carrier tube 10 is preferably constructed from a generally tubular plastics material member which has an opening 19 at its first upper end 24 and a second closed lower end 11 providing a head portion 12 for striking against a hard surface.

A boss 13 on the side of carrier tube 10 provides a suitable connection to a, preferably, aluminum steel shaft 14. A fluted plastics material tube 15 forms a handgrip which is suitably secured to the shaft 14. The boss 13, shaft 14, and handgrip 15 together form a handle for the carrier tube 10. In the preferred embodiment, the shaft 14 is perpendicular to the horizontal plane defined by the boss 13. Nevertheless, one of ordinary skill in the art will recognize that the shaft 14 may be angled 10 to 15 degrees away from the horizontal plane defined by boss 13 in a direction away from closed lower end 11.

The diameter of an inner surface 17 of the carrier tube 10 is larger than the largest cartridge expected to be used in the bullet puller 5. The lower end 18 of the inner surface 17 of the carrier tube 10 is preferably tapered to provide a surface tangent to an arcuate nose 20 of a bullet 21 so as to slowly frictionally arrest the downward travel of the bullet 21 when it is freed from its case 22.

The bullet 21 and the case 22, which are crimped thereto at 23, form part of a cartridge 25. A cannelure or annular groove 26 separates the main cylindrical tubular portion of the case 22, which carries the powder charge, from the head 27 of the cartridge 25 which has a primer/detonator cap (not shown) disposed therein.

The first upper end 24 of the carrier tube 10 includes a planar upper surface 41 and is provided with an external helical screw thread 30 correlative to an internal helical screw thread 31 of generally cylindrical cup-shaped screw cap 33. The cap 33 is preferably made of a plastics material similar to that of the carrier tube 10. The upper end 36 of the cap 33 has a cylindrical opening or bore 34 which is of slightly larger diameter than the cylindrical inner surface 17 of the carrier tube 10. A cam surface 35 of the end 36 of the cap 33 is conical and flares toward the open end of cap 33. Preferably the outer periphery of the closed end of the cap 33 is provided with a bevel 38. The exterior surface of the sides of the cap 33 may be knurled for easy turning.

An insert 40 resides atop the planar upper surface 41 of the carrier tube 10 and extends into the opening 19 of the carrier tube 10. An annular segmented support 42 includes a plurality of segments 43 and surmounts the insert 40 in order to support the cartridge 25 within the carrier tube 10. In the preferred embodiment, the annular segmented support 42 includes three segments 43 and is disclosed in U.S. Pat. Nos. 5,533,246 and 5,333,367, the disclosures of which are herein incorporated by reference. The cap 33 positively moves the segments 43 of the annular segmented support 42 radially inwardly and holds them in position atop the insert 40 at the opening 19 of the carrier tube 10. As the cap 33 screws down, the cam surface 35 thereof moves the segments 43 inwardly under an upper side 50 of the cannelure 26 so that the segments 43 fit snugly against the smallest diameter portion of the cannelure 26. The cap 33 retains the segments 43 in that position on the insert 40 at the opening 19 of the carrier tube 10. The kinetic/inertial bullet puller 5 is then ready to use.

Referring specifically to FIGS. 3-6, the insert 40 defines an aperture 54 therethrough and includes a platform 55 located atop a base 56. The diameter of the aperture 54 of the insert 40 is slightly larger than the largest cartridge expected to be used in the bullet puller 5. In the preferred embodiment, the platform 55 and the base 56 are constructed integrally from a metal, including but not limited to aluminum, using well known techniques, such as machining or metal injection molding; although one or ordinary skill in the art will recognize that the platform 55 and the base 56 may be made from separate parts.

The platform 55 is sized substantially, completely the same as the planar upper surface 41 at the first upper end 24 of the carrier tube 10 such that the platform 55 substantially, completely sits atop and covers the planar upper surface 41 while still allowing the securing of the cap 33 with the carrier tube 10. The platform 55 protects the planar upper surface 41 of the carrier tube 10 during use of the bullet puller 5. Although the preferred embodiment discloses the platform 55 sized substantially, completely the same as the planar upper surface 41 at the first upper end 24 of the carrier tube 10, one of ordinary skill in the art will recognize lesser sizes for the base 56.

The diameter of the base 56 is slightly less than the diameter of the opening 19 at the first upper end 24 of the carrier tube 10 such that the base 56 fits within the opening 19 directly adjacent the portion of the inner surface 17 of the carrier tube 10 at the opening 19. The base 56 maintains the platform 55 atop the planar upper surface 41 in alignment therewith and further protects the entrance into the opening 19 of the carrier tube 10 during use of the bullet puller 5. Although the preferred embodiment discloses the base 56 sized for location directly adjacent the portion of the inner surface 17 of the carrier tube 10 at the opening 19, one of ordinary skill in the art will recognize lesser diameters for the base 56 as long as the largest cartridges expected for use in the bullet puller 5 pass through the base 56 and thus the aperture 54.

To operate the bullet puller 5, a user positions the insert 40 at the first upper end 24 of the carrier tube 10 such that the platform 55 substantially, completely sits atop and covers the planar upper surface 41 of the carrier tube 10 and the base 56 fits within the opening 19 directly adjacent the portion of the inner surface 17 of the carrier tube 10 at the opening 19. The user places the annular segmented support 42 on the platform 55 and then secures the cap 33 with the carrier tube 10 over the annular segmented support 42 and the platform 55. The user introduces a cartridge 25 into the first upper end 24 of the carrier tube 10 through the opening 34 of the cap 33. As the user introduces a cartridge 25, the nose 20 of the bullet 21 wedges the segments 43 of the annular segmented support 42 apart as it passes therethrough. Likewise, the case 22 wedges the segments 43 of the annular segmented support 42 apart as it passes therethrough until the segments 43 contact the upper side 50 of the cannelure 26. Once the segments 43 engage the upper side 50 of the cannelure 26, the user tightens the cap 33, whereby the cam surface 35 thereof moves the segments 43 of the annular segmented support 42 radially inwardly to hold them in position atop the insert 40 at the opening 19 of the carrier tube 10. Moreover, as the cap 33 screws down, the cam surface 35 thereof moves the segments 43 inwardly under the upper side 50 of the cannelure 26 such that the segments 43 fit snugly against the smallest diameter portion of the cannelure 26 in order to retain the cartridge 25 at the opening 19 of the carrier tube 10 with the case 22 and the bullet 21 disposed interior to the carrier tube 10 above its second closed lower end 11.

The user grasps the handgrip 15, swings the bullet puller 5 thereby imparting a high speed to the carrier tube 10, and strikes the head portion 12 at the lower end 11 of the carrier tube 10 against a hard surface with the carrier tube 10 moving such that its axis is perpendicular to the surface at the moment of impact. The carrier tube 10 comes to rest and may bounce off of the hard surface. In any event, the first upper end 24 of the carrier tube 10 and thus the insert 40 come to rest slightly later than the second closed lower end 11 as determined by a speed of propagation of a kinetic/elastic shock wave in the plastic of the carrier tube 10. The speed of this kinetic/elastic shock wave will determine the increment of time during which the momentum of the case 22 is changed from its initial downwardly directed maximum magnitude just prior to impact of the carrier tube 10 with the hard surface to a zero or upwardly directed magnitude, and this in turn is proportional to the force exerted tending to pull the case 22 and bullet 21 apart. It may be considered that, when the kinetic energy shock wave reaches the annular segmented support 42, the upwardly moving first upper end 24 of the carrier tube 10 via the insert 40 pushes the segments 43 upwardly relative to the cartridge 25, and the upper ends of the segments 43 bearing against the upper side 50 of the cannelure 26 pull the case 22 from the bullet 21. The faster the kinetic energy shock wave moves the faster the first upper end 24 of the carrier tube 10 and thus the insert 40 move relative to the case 22, or, otherwise expressed, the more quickly the case 22 is brought to rest. Thus, the carrier tube 10 is preferably made of a material that transmits kinetic/elastic shock waves at a high velocity but has a high impact strength so that it will not shatter. A polycarbonate plastics material, having a kinetic/elastic shock wave velocity of 6,000 ft./sec, is a suitable material for the carrier tube 10. Suitable material may be described as being rigid and tough.

After striking the head portion 12 of the carrier tube 10 against a hard surface, the bullet 21 falls free of the case 22 into the second closed lower end 11 of the carrier tube 10. Preferably, the carrier tube 10 is made from a transparent material so that the separation of the bullet 21 from the case 22 may be observed, although the rattling of the loose bullet 21 in the carrier tube 10 will make this known by sound and shock in any event.

The user loosens the cap 33, backing it off sufficiently so that the cam surface 35 is spaced axially from the top surfaces of the segments 43, far enough so that the segments 43 expand to free the case 22 and allow passage of the bullet 21. The user inverts the carrier tube 10, and the case 22, the bullet 21, and the powder are shaken out of the carrier tube 10, with the segments 43 expanding under the force of the moving cartridge components. After the carrier tube 10 has been emptied, the user may insert another cartridge 25 into the bullet puller 5 as previously described.

The inclusion of the insert 40 in the bullet puller 5 extends the operational life thereof. Particularly, the platform 55 of the insert 40 protects the planar upper surface 41 of the carrier tube 10, while the base 56 of the insert 40 protects the entrance into the opening 19 of the carrier tube 10. The kinetic energy shock wave imparted into the carrier tube 10 creates a force experienced at the first upper end 24 of the carrier tube 10 in the form of an impact of the annular segmented support 42. However, in accordance with the present invention, the insert 40 substantially, completely absorbs the impact of the annular segmented support 42 and further distributes the impact away from the edges of the planar upper surface 41 and the opening 19 of the carrier tube 10. The metal insert 40, therefore, reduces the wear of the plastic carrier tube 10 and further inhibits damage thereto by protecting the plastic carrier tube 10 from the impact force of the annular segmented support 42. As such, the insert 40 increases the operational life of the bullet puller 5.

The inclusion of the insert 40 in the bullet puller 5 further improves the performance of the bullet puller 5 in separating a bullet 21 from a case 22. The insert 40 due to its metal construction concentrates the kinetic energy shock wave at the annular segmented support 42, thereby increasing the upwardly directed pushing force of the annular segmented support 42 relative to the cartridge 25. As a result of the increased upwardly directed pushing force of the annular segmented support 42, the upper ends of the segments 43 bearing against the upper side 50 of the cannelure 26 more easily pull the case 22 from the bullet 21. The concentration of the kinetic energy shock wave at the annular segmented support 42 by the insert 40, accordingly, increases the pulling power of the bullet puller 5, thus reducing the effort required to extract a bullet 21 from a case 22.

The insert 40 of the present invention may be employed to extend the operational life of prior manufactured and used bullet pullers. The insert 40 is utilized in a prior manufactured or used bullet puller as previously described. Moreover, multiple inserts 40 may be manufactured wherein each insert 40 includes an aperture 54, a platform 55, and a base 56 sized differently than the apertures 54, the platforms 55, and the bases 56 of the other inserts 40. A user selects an insert 40 from the group of multiple inserts 40 whereby the platform 55 of the selected insert 40 is sized to fit within a space of a planar upper surface 41 for the user's bullet puller 5 and the base 56 of the selected insert 40 is sized to fit within an opening 19 of the user's bullet puller 5. The user then employs the selected insert 40 in the user's bullet puller as previously described.

Although the present invention has been described in terms of the foregoing preferred embodiment, such description has been for exemplary purposes only and, as will be apparent to those of ordinary skill in the art, many alternatives, equivalents, and variations of varying degrees will fall within the scope of the present invention. That scope, accordingly, is not to be limited in any respect by the foregoing detailed description; rather, it is defined only by the claims.

The invention claimed is:

1. A bullet puller, comprising:

a carrier tube having an opening at its upper end adapted to receive a cartridge and a head at its lower end adapted to be struck against a hard surface;

an insert disposed about the upper end of the carrier tube;

an annular segmented support disposed atop the insert for engaging the cartridge;

a cap movably securable over the opening at the upper end of the carrier tube for moving the annular segmented support radially inward; and a handle connected at one end to the carrier tube for imparting motion to the carrier tube to strike it against the hard surface.

2. The bullet puller according to claim 1, wherein the upper end of the carrier tube includes a planar upper surface about the opening.

3. The bullet puller according to claim 2, wherein the insert defines an aperture and comprises a platform located atop a base.

4. The bullet puller according to claim 3, wherein the diameter of the aperture of the insert is larger than the largest cartridge used in the bullet puller.

5. The bullet puller according to claim 3, wherein the platform and the base are constructed from a metal.

6. The bullet puller according to claim 3, wherein the platform resides atop the planar upper surface of the upper end of the carrier tube thereby protecting the planar upper surface during use of the bullet puller.

7. The bullet puller according to claim 3, wherein the platform resides atop the planar upper surface of the upper end of the carrier tube and substantially, completely covers the planar upper surface thereby protecting the planar upper surface during use of the bullet puller.

8. The bullet puller according to claim 6, wherein the base fits within the opening of the carrier tube thereby protecting an entrance into the opening during use of the bullet puller.

9. The bullet puller according to claim 7, wherein the base fits within the opening of the carrier tube directly adjacent a portion of an inner surface of the carrier tube at the opening, whereby the base maintains the platform atop the planar upper surface in alignment therewith and further protects an entrance into the opening.

10. The bullet puller according to claim 5, wherein:

the carrier tube is constructed from a plastic; and the metal insert protects the upper end of the plastic carrier tube.

11. The bullet puller according to claim 10, wherein the metal platform resides atop the planar upper surface of the upper end of the plastic carrier tube thereby protecting the planar upper surface during use of the bullet puller.

12. The bullet puller according to claim 10, wherein the metal platform resides atop the planar upper surface of the upper end of the plastic carrier tube and substantially, completely covers the planar upper surface thereby protecting the planar upper surface during use of the bullet puller.

13. The bullet puller according to claim 11, wherein the metal base fits within the opening of the plastic carrier tube thereby protecting an entrance into the opening during use of the bullet puller.

14. The bullet puller according to claim 12, wherein the metal base fits within the opening of the plastic carrier tube directly adjacent a portion of an inner surface of the plastic carrier tube at the opening, whereby the metal base maintains the metal platform atop the planar upper surface in alignment therewith and further protects an entrance into the opening.

15. The bullet puller according to claim 1, wherein:

the carrier tube is constructed from a plastic; and the insert is constructed from a metal, wherein the metal insert concentrates a kinetic energy shock wave at the annular segmented support, thereby increasing an upwardly directed pushing force of the annular segmented support relative to the cartridge.

16. A method of extending an operational life of a bullet puller, comprising:

providing a bullet puller, comprising:

a plastic carrier tube having at its upper end a planar upper surface and an opening and having at its lower end a head, an annular segmented support, a cap movably securable over the opening at the upper end of the plastic carrier tube, and a handle connected at one end to the plastic carrier tube;

providing a metal insert;

placing the metal insert atop the upper end of the plastic carrier tube, thereby protecting the upper end of the plastic carrier tube;

placing the annular segmented support atop the metal insert;

securing the cap over the opening at the upper end of the plastic carrier tube;

introducing a cartridge into the upper end of the plastic carrier tube through an opening in the cap until the cartridge resides atop the annular segmented support;

tightening the cap; and striking the head of the plastic carrier tube against a hard surface using the handle until a bullet of the cartridge separates from a case of the cartridge.

17. The method of extending an operational life of a bullet puller according to claim 16, wherein placing the metal insert atop the upper end of the plastic carrier tube, thereby protecting the upper end of the plastic carrier tube, comprises:

placing a metal base of the insert within the opening of the plastic carrier tube thereby protecting an entrance into the opening during use of the bullet puller; and placing a metal platform atop the planar upper surface of the upper end of the plastic carrier tube thereby protecting the planar upper surface during use of the bullet puller.

18. The method of extending an operational life of a bullet puller according to claim 16, wherein placing the metal insert atop the upper end of the plastic carrier tube concentrates a kinetic energy shock wave at the annular segmented support, thereby increasing an upwardly directed pushing force of the annular segmented support relative to the cartridge.

19. A method of extending an operational life of a bullet puller, comprising:

providing a bullet puller, comprising:

a plastic carrier tube having at its upper end a planar upper surface and an opening and having at its lower end a head, an annular segmented support, a cap movably securable over the opening at the upper end of the plastic carrier tube, and a handle connected at one end to the plastic carrier tube;

providing multiple metal inserts, wherein each metal insert includes a different diameter aperture, a differently sized platform, and a differently sized base;

selecting a metal insert from among the multiple metal inserts, whereby the platform of the selected metal insert is sized to fit within a space of the planar upper surface of the plastic carrier tube and the base of the selected metal insert is sized to fit within the opening of the plastic carrier tube;

placing the selected metal insert atop the upper end of the plastic carrier tube, whereby the base of the selected metal insert fits within the opening of the plastic carrier tube thereby protecting an entrance into the opening during use of the bullet puller, further whereby the platform of the selected metal insert resides atop the planar upper surface of the upper end of the plastic carrier tube thereby protecting the planar upper surface during use of the bullet puller;

placing the annular segmented support atop the selected metal insert;

securing the cap over the opening at the upper end of the plastic carrier tube;

introducing a cartridge into the upper end of the plastic carrier tube through an opening in the cap until the cartridge resides atop the annular segmented support;

tightening the cap; and striking the head of the plastic carrier tube against a hard surface using the handle until a bullet of the cartridge separates from a case of the cartridge.

20. The method of extending an operational life of a bullet puller according to claim 19, wherein placing the selected metal insert atop the upper end of the plastic carrier tube concentrates a kinetic energy shock wave at the annular segmented support, thereby increasing an upwardly directed pushing force of the annular segmented support relative to the cartridge.

* * * * *